United States Patent [19]

Gauchard

[11] 4,367,461

[45] Jan. 4, 1983

[54] COFFIN ALARM SYSTEM

[76] Inventor: Fernand Gauchard, Parc du Beau, Santeny (Val de Marne), France

[21] Appl. No.: 202,368

[22] Filed: Oct. 30, 1980

[30] Foreign Application Priority Data

Oct. 31, 1979 [FR] France ..... 79 26991

[51] Int. Cl.[3] ..... G08B 21/00

[52] U.S. Cl. ..... 340/573; 340/575

[58] Field of Search ..... 340/573, 575

[56] References Cited

U.S. PATENT DOCUMENTS 766,171 8/1904 Crosby et al. ..... 340/573

FOREIGN PATENT DOCUMENTS 386057 6/1908 France .
390485 10/1908 France .
1065868 5/1954 France .
1150656 1/1958 France .

*Primary Examiner*—Alvin H. Waring
*Attorney, Agent, or Firm*—Young & Thompson

[57] ABSTRACT

An alarm system for coffins includes a pick-up device which is capable of being actuated by a movement of the body in the coffin and which can close a circuit with a power source, to which is connected at least one alarm device. The pick-up device controls a memory device which memorizes the function of the pick-up and closes the alarm circuit. The system will give the alarm if someone is buried alive.

2 Claims, 6 Drawing Figures

COFFIN ALARM SYSTEM

The present invention concerns an alarm system for a coffin.

The exhumation of American soldiers following recent wars furnished indications that a certain percentage of bodies had been interred living. Also, an inquest into this problem in Great Britain has revealed that the number of living burials was approximately 2700 per year. French Pat. No. 73 46933 and its application for certificate of addition No. 77 02751 describe places of interment having networks of passages to collect liquids and gases emanating from coffins, and means to lower the temperature in the coffin. By virtue of this fact, the means already exist to assure a certain air exchange in the coffin, which allows an interred living being who regains consciousness in the hours following burial to breathe a minimum of air while awaiting help. Burial vaults also leave a volume of air around the coffins sufficient that a human being in semilethargic state can breathe, if this surrounding volume of air is placed in communication with the inside of the coffin. Gaseous exchanges could also be effected through the layers of earth which have just been moved and that could also allow survival in the semi-lethargic state. However, the coffin which is disclosed is provided with a device which, if the body awakes, activates an alarm to call for help and optionally to improve the aeration of the coffin, before its opening.

Previously proposed alarm systems, for example those disclosed in French Pat. Nos. 1,150,656, 386,057 or 1,065,868, use pick-up or detection devices which detect any movement of the buried body some of which can result from displacement or transportation of the coffin or from putrefaction, eructation or belching, falling off of the tissues and other motor phenomena occuring to a cadaver.

The object of the present invention is to provide such an alarm system functioning reliably but not responding to the natural movements of a cadaver, applicable to coffins whatever the type of burial, but particularly to coffins stored in frameworks of places of interment, and including a drainage network, particularly a network which places the inside of the coffins at lower pressure.

The object of the present invention is achieved by providing a coffin alarm system having a pick-up device which closes a circuit comprising a source to which is connected at least one alarm device, characterized in that the pick-up device controls a memory device which memorizes the function of the pick-up and closes the alarm circuit.

According to a second characteristic, an aeration device to aerate the inside of the coffin, including at least one valve and preferably an air pump, is actuated by the closing of the alarm device circuit.

The signal device of the alarm system can be placed directly on the coffin, particularly when the lethargic awakening is to be detected sometime between placing the body in the coffin and burial. It can be placed in proximity with the tomb or with the burial vault in the case of traditional burials. On the other hand, in places of interment of the type described in French Pat. No. 73 46933 and in its application for certificate of addition No. 77 02751, the signal device is preferably mounted in the visitor's gallery with a cellular signal device.

The memory device and the power source are preferably lodged in the coffin, if the alarm system must function between placing the body in the coffin and burial; they can however be outside the coffin in the other cases, to lower the cost of the coffin, which limits the number of elements which must be placed in the coffin and then lost, when as a practical matter the surveillance will be very certainly less than one month.

According to one embodiment, the pick-up device is comprised of at least two conductor elements which are mounted facing each other on the inside of the cover of the coffin, preferably directly above the hands of the body which is in the coffin, in such a manner that they are brought into contact when a hand is raised. According to one embodiment, the two conductive elements are comprised of a first conductive sheet adhered onto the bottom of the cover and a second conductive sheet suspended under the first, at some distance from it.

In one variation, the pick-up device, also of the pressure type, is mounted in such an arrangement that it is actuated by the knees or by pressure against the top part of the side walls.

In another embodiment, the pick-up device is comprised of pull contactors in which one or more pull cords hang freely from the cover of the coffin.

The memory device can be comprised of an automatic power relay or any other equivalent electronic device. To avoid false alarms, the memory device can be conceived to act only after several contacts, for example of such a type that the alarm circuit is closed after at least two closings of the pick-up, separated by an open period of prefixed minimum duration.

Various embodiments of the invention will be described in more detail hereinafter with reference to the attached drawings, wherein.

Figure 1:
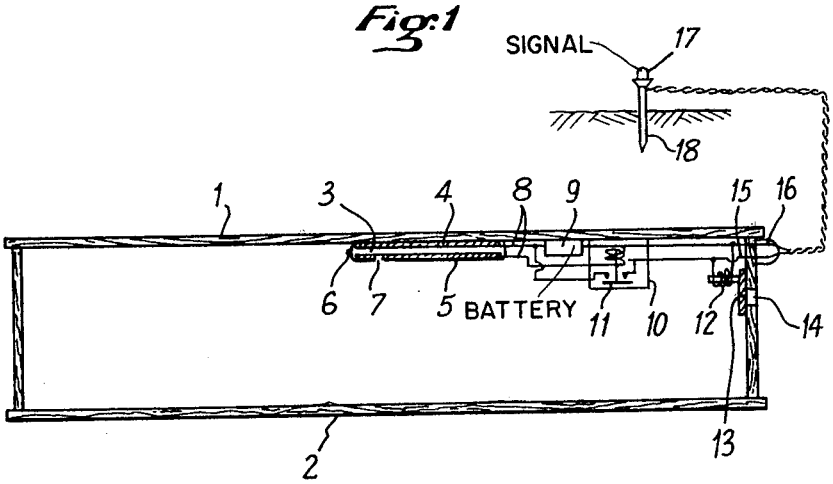
FIG. 1 is a longitudinal cross section of a coffin which is ready to be interred provided with a simplified alarm device.

In the various embodiments, contact 3 which could be of any known type, and for greater sensitivity is comprised of a plate 4, for example a light aluminum sheet, is affixed on the inside surface of the cover 1 of coffin 2, and an identical plate 5 is placed opposite, the two plates being enclosed in a welded plastic pocket 6, so as to maintain a slight spacing between them. The inside of this pocket is in communication with the inside of the coffin through a small orifice 7 which buffers the movement of the two plates by braking the evacuation of the air volume from the inside and assures the equilibrium of the pressures so that a gaseous overpressure inside the coffin does not generate a false contact. Two conductors 8 are connected one to each of the plates 4 and 5.

In the embodiment of FIG. 1, a battery 9 and an automatic power relay 10 are affixed under the cover, with the battery feeding relay 10 through conductors 8 and contact 4-5 or through the closed armature 11 of the relay. Armature 11 of the relay closes the circuit of an electromagnet 12 of which the movable armature forms a lock by an obturator flap 13 closing an orifice 14 in the wall of the coffin in such a manner that, when the electromagnet is excited, orifice 14 is opened to place the interior of the coffin in communication with the outside. The circuit closed by armature 11 of the relay terminates in a socket 15 in the wall of the coffin, into which a lamp visible from the outside may be inserted from the moment of closure of the coffin until the burial; or a male plug 16 electrically connected to a light 17 or any other alarm device mounted on a post 18 is implanted in proximity to the burial place.

Figure 2:
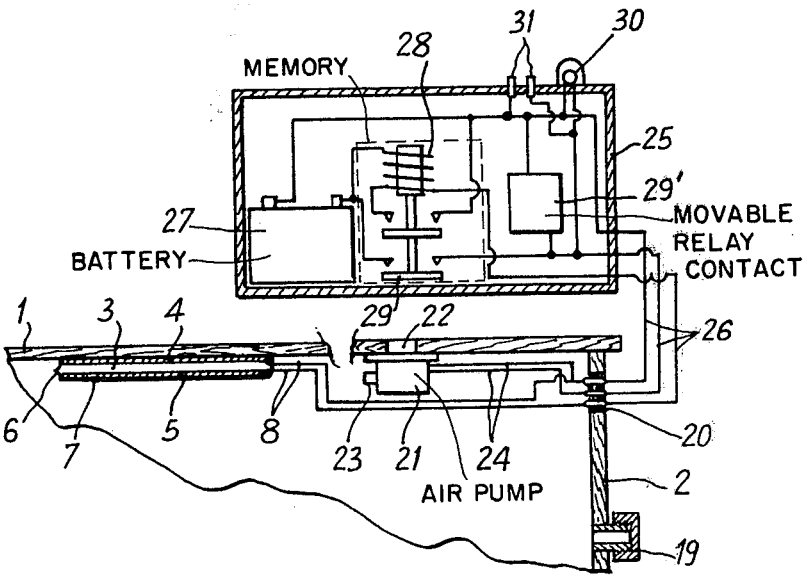
FIG. 2 is a cross section of a part of a coffin which is ready to be placed in a place of interment and connected to an alarm device which can be used in burial systems directly in the earth, in a burial vault or in a place of interment.

In the embodiment shown in FIG. 2, the coffin has a connection 19 for connection to a circuit to place the coffin at lower pressure, to assure the evacuation of the gases. Conductors 8 are attached to a plug 20 in the wall of the coffin. An electromagnetic air pump 21 is affixed under cover 1 to aspirate the air out of the coffin through an orifice 22 and feed it back through a discharge 23 into the coffin. Feed conductors 24 of this pump also terminate in plug 20. The alarm device is outside the coffin and lodged in a casing 25 which can be placed beside the coffin until the burial either above ground or in the burial vault. The coffin and the alarm device are connected by an electric cable 26.

The alarm device inside the box 25 is comprised of a feed battery 27, and a self-excitation relay 28 closed by contact 3. The closing of the movable contact 29 of the relay assures the feed through cable 26, electromagnetic pump 21, and also the feed of a buzzer 29', a light 30 mounted on the casing and a plug 31 to which can be connected to the general alarm circuit or a remote alarm device of the radio emitter type, which remote alarm device can be lodged in casing 25.

Figure 3:
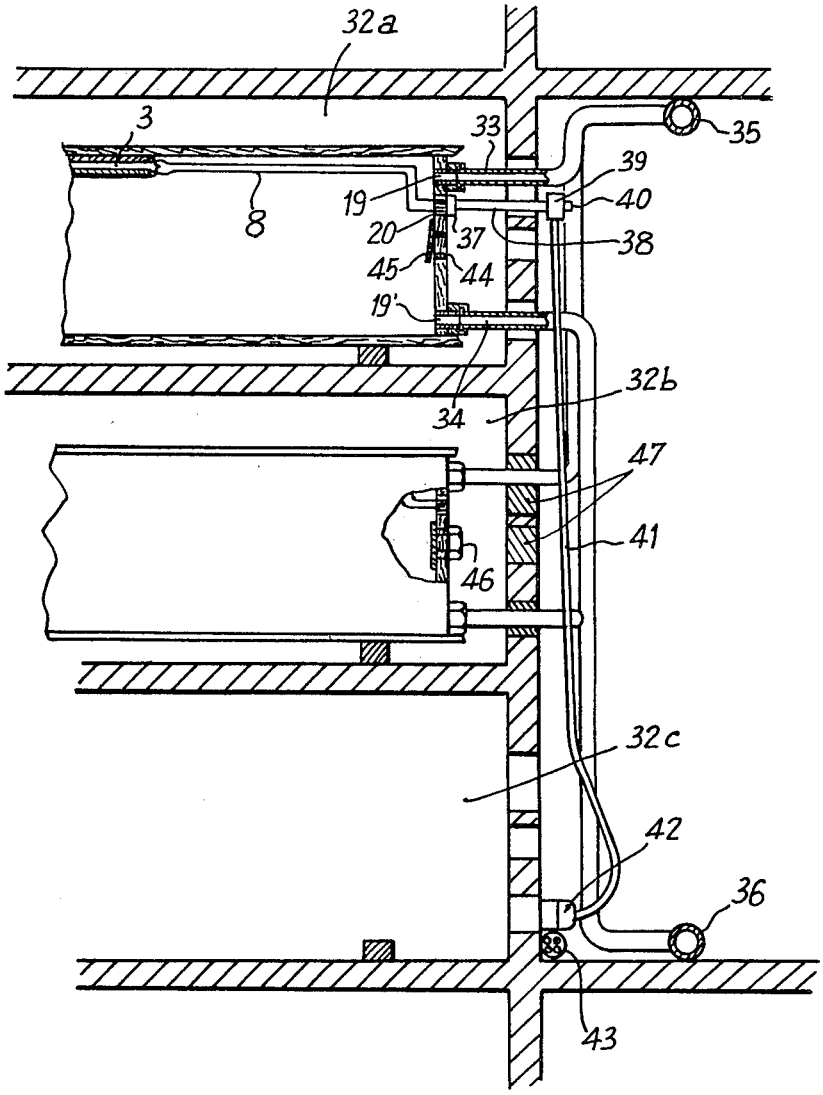
FIG. 3 is a diagram of an alarm system mounted in a place of interment of a type analogous to that described in French certificate of addition No. 77 02751.

In the embodiment of FIG. 3, the coffin is analogous to that of FIG. 2 and the same elements are designated by the same reference numbers. This coffin is placed in a framework 32 of a place of interment. The coffin is connected by conduits 33 and 34 to the aspiration connection 19 and to the drainage connection 19', to two collectors 35 and 36, in a service gallery, connected to drainage devices, the collector 35 being subjected to a vacuum. Socket 20 can receive a male plug 37, can have a probe 38 with a casing 39 in which is mounted an automatic power relay which is analogous to relay 11 and on which is mounted a warning light 40, connected by a plug 42 to a circuit 43 which has feed conductors and conductors leading to the central alarm station which can include a sounding device.

The coffin also has a tapped orifice 44 with a flexible sheet 45 forming a valve flap in such a manner as to allow the entry of air from the service gallery and from cell 32*a* into the coffin under the effect of the suction in the passageway 35, this suction being sensed by the alarm device so as to increase the oxygen feed to all of the coffins under observation in case of an alarm.

After the period of observation, which can be from one to two weeks, the probe 38 is withdrawn and disconnected, the tapped hole 44 is closed by a plug 46 and the cell is isolated by plugs 47 as shown for cell 32*b*, the coffin in cell 32*a* still being under observation and the cell 32*c* being empty.

Figure 4:
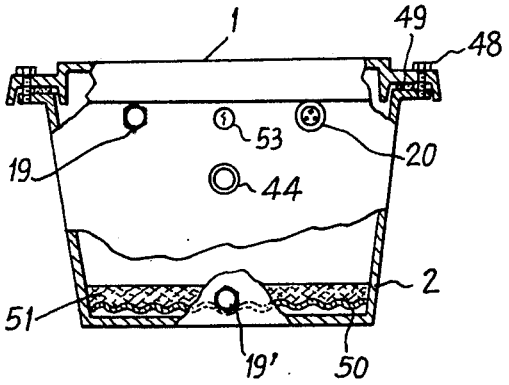
FIG. 4 is an end view of a coffin for burial in a place of interment.
Figure 5:
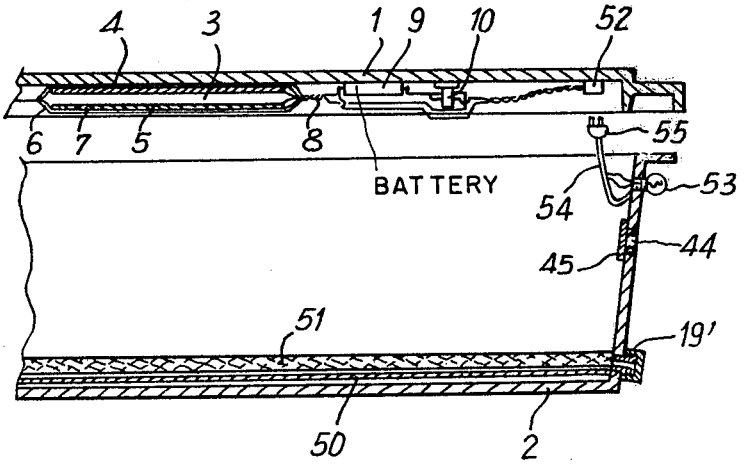
FIG. 5 is a longitudinal cross section of the head of this coffin.

The embodiment shown in FIGS. 4 and 5 concerns a coffin which is intended for burial in a place of interment which can be used as in the situation shown in FIG. 3. These figures show the lining 2 of the coffin and cover 1 affixed to the lining by bolts 48 with a sealing joint 49. The base of the coffin has a corrugated metal sheet 50 under a mattress 51 which is saturated with products which absorb and neutralize the products of decomposition, the effluents being evacuated through connection 19'.

Under the cover are affixed pick-up device 3, battery 9 and relay 10, the conductor cables being connected to a socket 52. On the head wall are affixed connections 19 and 19', a warning light 53 and a plug 20. Warning light 53 and plug 20 are connected by a conductor 54 to a plug 55 which, at the moment of the closing of the coffin, can be plugged into socket 52. Light 53 provides that box 25 need not be near the coffin between the closing of the coffin and the burial. This light 53 can be coupled with a buzzer.

Figure 6:
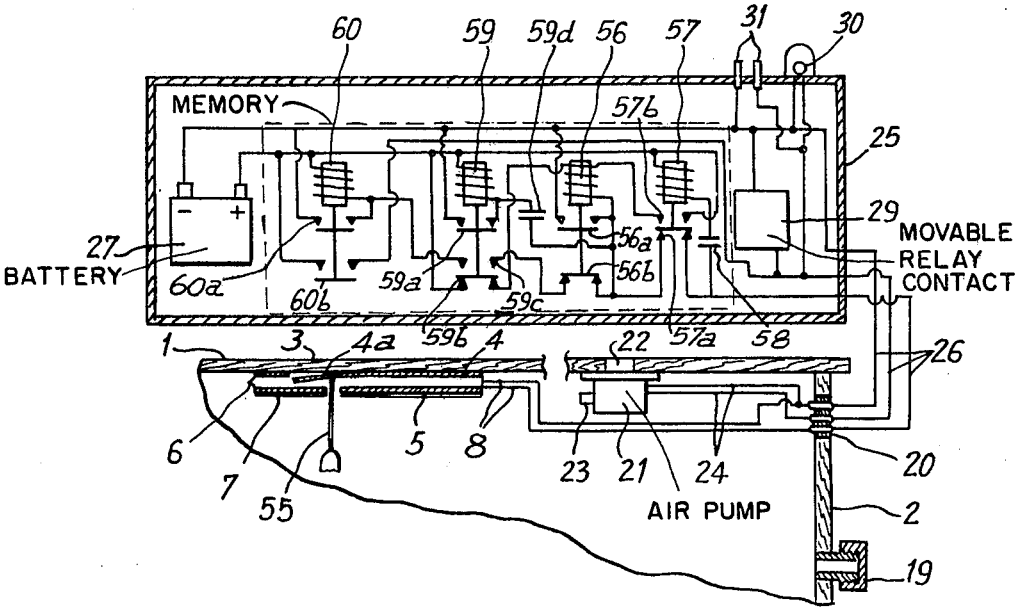
FIG. 6 illustrates a variation of the alarm system of FIG. 2.

The modification of the pick-up illustrated in FIG. 6 resides in that an elastic lamella 4*a* is cut out in plate 4 of the pick-up and near the ned of the lamella (for clarification, shown slightly deformed) is affixed a pull cord 55 which passes through an orifice in plate 5. The pick-up functions either by pressure or by pulling.

The memory device of FIG. 6 is also modified so that the alarm functions only after two actuations of the pick-up.

This memory device includes a relay 56 with a self-excitation armature 56*a* and an armature acting upon the opening of 56*b*, a delayed closing relay 57 delayed by a capacitance 58, its armature causing the opening of 57*a* and the closing of 57*b*; a delayed closing relay 59 delayed by a capacitance 59*d* and closing 59*c*, and a relay 60 which includes a self-excitation armature 60*a* and an armature 60*b* assuring by its closing the feed of the alarm system. The relay coil 56 is fed both in parallel by contact 3 in series with the armature 57*a* at rest and by the self-excitation armature 56*a* and also by armature 59*b* closed when relay 59 is nonexcited, in parallel with armature 57*b* of relay 57, which is closed when this relay is excited, the first and the second groups above being in series with the coil of relay 56. The coil of the delayed relay 57 is fed by closing of contact 3 or by closing of self-excitation armature 56*a* of relay 56 in series with the armature 57*a* closed in the nonexcited state of relay 57. The coil of delayed relay 59, whose delay is greater than that of relay 57, is fed in parallel by its self-excitation armature 59*a*, self-excitation armature 56*a* of relay 56, and contact 3 in series with armature 57*a*, when relay 57 is at rest. The coil of relay 60 is fed from contact 3 by armature 57*a* when relay 57 is at rest, armature 56*b* when relay 56 is at rest, and armature 59*b* attracted by relay 59, and it is automatically fed by armature 60*a*.

The memory system functions in the following manner:

The closing of contact 3 places relay 56 in circuit through armature 57*a* of relay 57, which causes relay 56 to close its armatures and be automatically fed by armature 56*a*, whatever the state of contact 3. The closing of contact 3 also feeds the relays 57 and 59 through armature 56*a*. Relay 57 is first closed, then cuts its feed by armatures 56*a*, 57*a*, and closes 57*b* to maintain the feed of relay 56 in parallel with 59*b*. As long as contact 3 is closed, relay 57 is held closed. Relay 59 is then closed and cuts the feed of relay 56 by 59*b* at the same time that 59*a* is closed to assure the automatic feed of relay 59 independently of the closing of armature 56*a*. If contact 3 remains closed, relay 57 remains attracted, but if contact 3 has been opened by a pressure drop or a pull on control 55, the delayed relay 57 falls back after the closing of relay 59. 59*b* and 57*b* are opened, and the feed of relay 56 is cut, which assures closing of 56*b* and 59, which are self-excited, and relay 56 cannot function. If contact 3 is reclosed, the coil of relay 60 is fed by armature 59*c* of excited relay 59, armature 56*b* when relay 56 is at rest, armature 57*a* when relay 57 is at rest, and armatures 60*a*, 60*b* when relay 60 is closed, which assumes the automatic feed of relay 60 and the closing of the alarm circuit.

The embodiment of FIG. 6 has been disclosed as using electro-mechanical relays to better represent the signals, but it could also be realized electronically. For clarity, this memory device is shown housed in an independent casing connected to the coffin by cables 26; but it could also be partially or totally incorporated in the coffin as described with reference to FIGS. 1 and 5.

What is claimed is:

1. An alarm system for coffins, comprising an alarm circuit having means actuated by a movement of the body in the coffin, an electrical supply source, and at least one alarm device actuated by said supply source, said actuated means comprising at least two conductive elements which are mounted facing each other on the inside wall of the cover of the coffin directly above the hands of the human body in such a manner that they are brought into contact with each other when a hand is raised.

2. An alarm system for coffins, comprising an alarm circuit having means actuated by a movement of the body in the coffin, an electrical supply source, at least one alarm device actuated by said supply source, and a memory device which memorizes the functioning of said actuated means and controls the supply of electricity to the alarm device by closing the alarm circuit only after at least two separate actuations of said actuated means.

* * * * *